United States Patent [19]

Lindblom et al.

[11] 4,360,759

[45] Nov. 23, 1982

[54] IMAGE TUBE FOR PRODUCING OPTICAL IMAGES WITH HIGH RESOLUTION

[76] Inventors: Karl-Peter C. Lindblom, Ytternäsv, Nagu 21660, Finland; Allan Danielsson, Ängsvägen 7, Sollentuna, Sweden

[21] Appl. No.: 101,832

[22] Filed: Dec. 10, 1979

[30] Foreign Application Priority Data

Sep. 5, 1979 [FI] Finland ..... 792752

[51] Int. Cl.[3] ..... H01J 31/26; H01J 40/04

[52] U.S. Cl. ..... 313/381; 313/383; 313/102

[58] Field of Search ..... 313/381, 382, 383, 102

[56] References Cited

U.S. PATENT DOCUMENTS

| | | | |
|---|---|---|---|
| 2,396,023 | 3/1946 | Schantz | 313/381 X |
| 3,225,237 | 12/1965 | Cope | 313/382 X |
| 3,295,010 | 12/1966 | Clayton | 313/381 X |
| 3,329,856 | 4/1967 | Foote | 313/102 X |
| 3,341,734 | 9/1967 | Nicholson | 313/381 X |

OTHER PUBLICATIONS

"Beam Loop Shape in Image Dissectors" by E. H. Eberhardt, Technical Note No. 107 from Electro-Optical Products Division ITT, Jun. 1969, pp. 1-9.

"A Survey of Image Dissector Performance Characteristics", Technical Note 112 from Electro-Optical Products Division ITT, Jan. 1970, pp. 1-23.

*Primary Examiner*—Palmer C. Demeo

[57] ABSTRACT

An image tube for electrical measurement of optical images comprises a vacuum vessel having a photocathode at one end and a mesh intermediate its ends. The images are produced with high resolution when the distance from said photocathode to said mesh ($L_1$) and the total extension ($L_2$) along a central axis of the tube in the path of movement of the electrons are selected by means of the following mathematical relations:

$$L_2 > L_1 \geqq \left(\frac{3}{8n-3}\right) L_2$$

the symbol n denoting an integer indicating the number of revolutions rotated by the electrons along their path of movement.

5 Claims, 4 Drawing Figures

IMAGE TUBE FOR PRODUCING OPTICAL IMAGES WITH HIGH RESOLUTION

Image tubes for producing optical images and for converting these into electric signals occur commonly within the TV-technology. Tubes of different types are available on the market, developed for their respective purposes. A common feature of all these tubes is the so-called photocathode, onto which the optical image is projected. From the photocathode, photoelectrons are emitted, the number of which per unit time is in proportion to the intensity of the image in each particular point on the photocathode. The registration of these photoelectrons therefore gives a signal that is a measure of the distribution of intensity of the optical image. The picking-up the registration, and the relating of the photoelectrons to the position on the photocathode are therefore the essential function of the image tube.

In image tubes for TV-technology this takes plate by means of a scanning electron beam which reads the charge-distribution produced by the photocathode on a dielectric. These tubes give sufficient resolution for TV-applications.

For more special applications, the recording of the image with high resolution is extremely important.

Tubes by means of which it is possible to obtain high resolution are, among others, the so-called "image dissector tubes." In these tubes the photoelectrons are accelerated from the photocathode through an electrostatic field parallel to the axis of the tube and extending through either the whole of, or parts of the tube space. Through a magnetic field produced by means of external magnetic coils, said field also directed along the tube axis, the accelerated photoelectrons are focused onto a metallic screen provided with a hole in its middle. The joint effect of the electrostatic and the magnetic fields yields an image corresponding to the optical image, in electrons, on said screen.

Behind the hole in the screen, there is an electron multiplier of known type, which intensifies the current of electrons through the hole to such a strength that it can be registered electronically. By means of two additional magnetic coils, which produce two magnetic fields directed perpendicularly to each other and to the tube axis, it is possible to deflect the image on the screen so that the electron current through the tube can be made to derive from photoelectrons emitted from any desired part of the photocathode. Thus, by means of these two latter so-called deflection fields it is possible to measure the entire optical image. Tubes of this type are described, e.g., in the publication ITT-Electron Tube Division Publications. Technical Note TN112.

The image dissector tubes that are on the market are mainly of two types. The first type consists of the so-called ring dissector tube. In this tube the electrostatic field is produced by means of ring-shaped electrodes placed along the interior walls of the tube and connected with electrical resistors so that an approximately homogeneous electrostatic field is produced in the entire tube space between the photocathode and the screen by the effect of an externally applied voltage. The advantage of this tube is that the same resolution can be maintained along the entire image surface on the photocathode, i.e. the resolution is not changed with deflection of the electron image on the screen. This is particularly true when the measurement takes place under so-called dynamic focusing of the tube, which means that the electrostatic field or the magnetic axial focusing field are varied synchronically with the deflection fields. Normally, it is not desirable to deflect the electrons by more than about 5° in the tube. This means that the distance between the photocathode and the screen becomes about 6 times as long as the diameter of the photocathode. Therefore, in order to obtain high resolution by means of tubes of ring-dissector type, the voltage that produces the electrostatic field in the tube becomes very high, frequently 16 to 30 kV. This constitutes the principal disadvantage of the ring-dissector tubes.

In the second type of image dissector tubes on the market the electrostatic field is limited between the photocathode and a mesh placed close to the photocathode. The mesh is fastened to one end of a metallic cylinder, the screen being fastened to the other end of the cylinder. The mesh, the cylinder, and the screen consequently form a space without an electrostatic field. Such tubes are manufactured, e.g., by ITT in the U.S.A. under the name of Vidissector® tubes. With these tubes the resolution without deflection field becomes very good even with as low voltages as 500 to 1000 volts. Therefore, these tubes have been considered to be the most attractive image dissector tubes. Recent observations have, however, proved that even with as low deflection angles as 2 to 4 degrees the resolution is deteriorated considerably, in certain cases by 10 to 20 times. This drawback constitutes the main disadvantage of this tube type.

Both of these drawbacks are eliminated by the present invention, which is mainly characterized by that the distance from the photocathode to the mesh, indicated by the symbol $L_1$ below, and the total extension along the axis of the path of movement of the electrons, indicated by the symbol $L_2$ below, are selected by means of the following mathematical relation:

$$L_2 > L_1 \geqq \left(\frac{3}{8n-3}\right) L_2,$$

wherein in the relation the symbol n denotes an integer that indicates the number of revolutions rotated by the electrons during their path of movement. It has been established that a tube constructed in this way gives a very good resolution even with large deflection angles and that relatively low voltages are sufficient, about 5000 to 15000 volts.

It is possible to operate with particularly low voltages and, nevertheless, obtain a very good resolution if $L_1 = \frac{1}{3}L_2$, n being $=2$. According to a preferred embodiment, n is maximum 5, preferably maximum 3.

The invention will be described below in detail with reference to a number of exemplifying embodiments of the same shown in the attached drawing, and in that connection further characteristics of the invention will be indicated.

In the drawing

Figure 1:
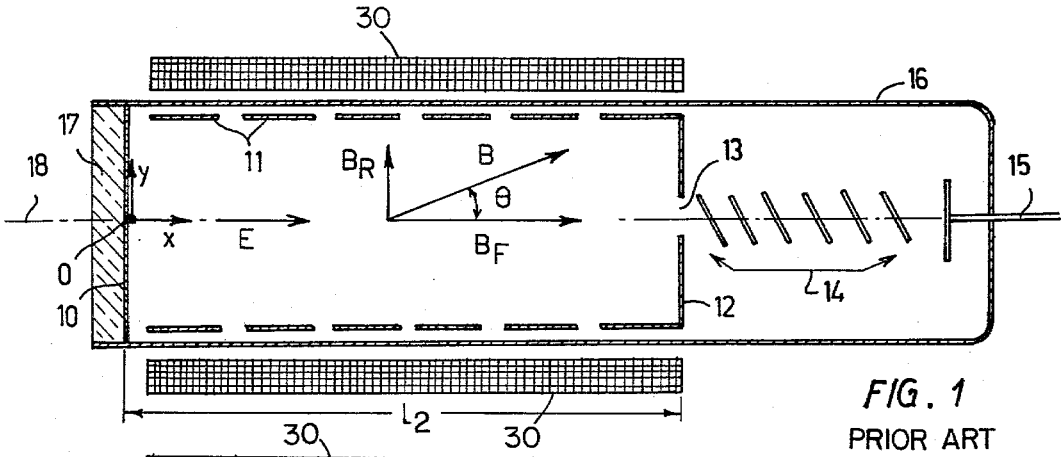
FIG. 1 PRIOR ART
FIG. 1 shows an image dissector tube of ring-dissector type.

In FIG. 1, numeral 16 denotes the cylindrical glass covering of the ring-dissector tube, a plane window 17 being fixed to one end of said covering. The covering 16 and the window 17 from a vacuum-tight vessel out of which all the air has been pumped out. On the inside of the window 17, a photocathode 10 has been laid in a way in itself known. In FIG. 1, numeral 11 schematically illustrates a number of ring-shaped electrodes which are connected to each other, to the photocathode 10, and to the metallic screen 12 through electrical resistors. The electrodes 11 are placed symmetrically around the axis of the tube, which axis is denoted with numeral 18 in FIG. 1. By the effect of an externally applied electrical voltage between the metallic screen 12 and the photocathode 10, in a way in itself known, an approximately homogeneous electrostatic field is obtained directed along the axis of the tube in the space between the photocathode 10 and the screen 12. A hole 13 has been made in the middle of the screen 12. Behind the hole a so-called electron multiplier of known type is positioned, denoted with numeral 14 in FIG. 1. The electrons flowing through the hole 13 are multiplied in the electron multiplier 14 and are picked up by the anode 15. The signal from the anode 15 is registered by an electronic equipment of known type, not shown in the drawing. The electrostatic field that is produced by the ring-shaped electrodes 11 has been denoted with an arrow in FIG. 1, and is denoted with the symbol E. By means of an external magnetic coil 30 a magnetic field is produced in the tube the field vector of which, indicated by an arrow and denoted with the symbol $B_F$ in FIG. 1, is parallel to the axis 18 of the tube. Further, two additional magnetic coils, not shown in the drawing, are used which each produces a magnetic field, the field directions of which are perpendicular to each other and both of them perpendicular to the axis 18 of the tube. These magnetic fields are added to each other and form a resultant magnetic field denoted with the symbol $B_R$ and indicated by an arrow in FIG. 1, whereby the magnitude and direction of the field vector $B_R$ are determined by the rules that are applicable to addition of vectors. Thus, the magnetic field vector $B_R$ is perpendicular to the axis 18 of the tube. Moreover, in FIG. 1 the projection of the tube shown has been selected so that the magnetic field vector $B_R$ lies in the plane of the paper. The magnetic field $B_R$ is added vectorially to the focusing magnetid field $B_F$, whereby the resultant magnetic field, denoted with B and indicated by an arrow in FIG. 1, lies also in the plane of the paper and forms an angle, denoted with $\theta$ in FIG. 1, with the axis 18 of the tube. FIG. 1 also shows a rectangular coordinate system, the origin of which, denoted with 0 in FIG. 1, is placed on the photocathode in its point of section with the axis 18 of the tube. The axes of the said coordinate system are oriented so that the axis denoted with X, i.e. the X-axis, coincides with the axis of the tube, whereby the positive direction of the X-axis runs towards the screen 12. Moreover, the axis denoted with Y, i.e. the Y-axis, is selected so that its direction coincides with the direction of the magnetic field vector $B_R$. Then the axis denoted with Z, i.e. the Z-axis, is directed perpendicularly upwards from the plane of the paper in FIG. 1. The distance between the photocathode 10 and the screen 12 has been denoted with the symbol $L_2$ in FIG. 1.

By means of an appropriate selection of the field intensities of the electrostatic field E and the magnetic focusing field $B_F$ it is possible to focus the photoelectrons emitted by the photocathode 10 into an image on the screen 12. This takes place when the intensity of the magnetic focusing field $B_F$ fulfills the following relationship:

$$B_F = \frac{\pi n}{L_2} \sqrt{\frac{2\,Vm}{e}} \tag{1}$$

wherein the symbol V denotes the externally applied electrical voltage, the symbol m denotes the mass of the electron, the symbol e denotes the electrical charge of the electron, the symbol $\pi$ denotes the numerical value of the ratio of the circumference of a circle to its diameter, and finally the symbol n denotes a positive integer, indicating the number of revolutions that the photoelectrons spin during focusing between the photocathode 10 and the screen 12. Usually the value 1 or 2 is used for n.

By selecting the direction and intensity of the magnetic field $B_R$ with the aid of the two deflection fields, it is possible to deflect the whole electron image on the screen 12 in two dimensions so that the photoelectrons emitted from any point whatsoever on the photocathode 10 can be made to pass through the hole 13 and be registered by means of the anode 15. In this way it is possible to measure the entire optical image on the photocathode 10.

The electron image on the screen 12, however, includes imaging defects, or aberrations which means that electrons emitted from a point on the photocathode 10 are not imaged on a point on the screen 12. These aberrations result from the fact that the photoelectrons are emitted from the photocathode 10 in different directions and with varying speeds. When no deflection is applied, the image on the screen 12 has an approximately circular extension. The diameter, denoted with D, of the extended electron image, of a point on the photocathode is expressed approximately by the following expression:

$$D = 2L_2(\epsilon/V) \tag{2}$$

wherein $\epsilon$ denotes the maximum energy in the unit electron-volt of the photoelectrons when these are emitted from the photocathode, and V denotes the externally applied electrical voltage between the photocathode 10 and the screen 12. If it is, for example, assumed that $\epsilon = 0.3$ electron-volts and that $L_2 = 200$ mm, a voltage of $V = 24{,}000$ volts must be applied to the tube in order that the diameter D of the electron image should not exceed 5 micrometers. With this voltage, the expression (1) indicates that a focusing field $B_F = 82.1$ Gauss must be selected for $n = 1$. With tubes of ring-dissector type in accordance with FIG. 1 it can be proved that the diameter D of the electron image is substantially independent of the deflection, whereby the optical image can be read with the same resolution over the entire photocathode.

Figure 2:
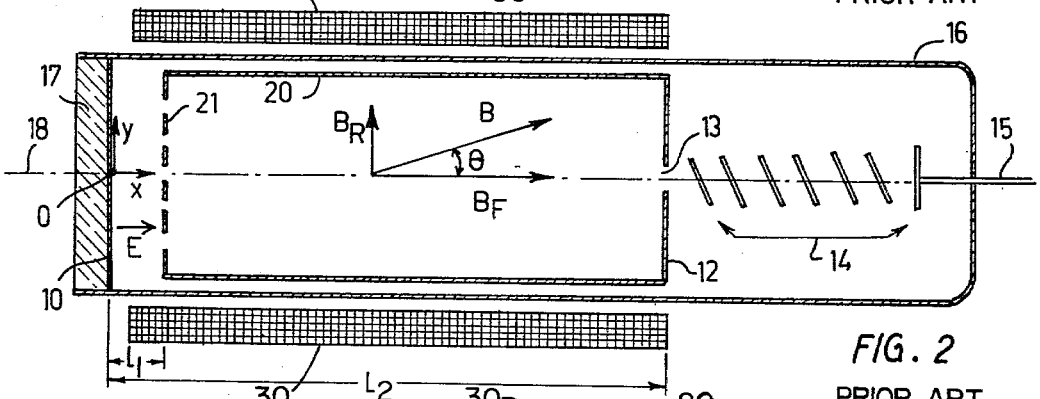
FIG. 2 PRIOR ART
FIG. 2 shows an image dissector tube of Vidissector type.

In FIG. 2 an image dissector tube of Vidissector type is shown. In FIG. 2 there are the tube covering 16, the window 17, the photocathode 10, the screen 12 with the hole 13, the electron multiplier 14, the anode 15, and the axis 18 of the tube. Moreover, FIG. 2 also indicates the distance between the photocathode 10 and the screen 12 with the symbol $L_2$. In FIG. 2 the screen 12 is fastened to a metallic cylinder 20, whose axis coincides with the tube axis 18.

A metallic mesh 21 is fastened to the other end of the cylinder 20. The length of the cylinder has been selected so that the metallic mesh 21 is placed close to the photocathode and is parallel to it. An externally applied voltage between the mesh 21 and the photocathode 10 produces an approximately homogeneous electrostatic field parallel to the tube axis 18, which field is denoted with E and indicated by an arrow in FIG. 2. Thereby, in the cylindrical space limited by the mesh 21, the cylinder 20, and the screen 12, there is no electrostatic field. In FIG. 2 there are also the magnetic fields $B_F$, $B_R$, and B, as well as the deflection angle $\theta$ given. Moreover, the coordinate system 0 has also been drawn into FIG. 2. The distance between the photocathode 10 and the mesh 21 has been denoted with $L_1$ in FIG. 2. By means of appropriate selection of the external voltage V and of the intensity of the focusing magnetic field $B_F$, the photoelectrons produced by the optical image on the photocathode can be imaged on the screen 12. This takes place when the intensity of the magnetic field $B_F$ is determined by the following relation:

$$B_F = \frac{2\pi n}{L_1 + L_2} \sqrt{\frac{2\,Vm}{e}} \tag{3}$$

wherein the symbols used have the same meanings as in the expression (1). In the same way as according to the tube illustrated in FIG. 1, the optical image can be measured by means of selection of the intensity and direction of the deflection magnetic field $B_R$. This tube also includes defects of reproduction in the electron image. The diameter D of the extended electron image of a point on the photocathodes is determined in the tube shown in FIG. 2 by the following approximative relation:

$$D = 2L_1(\epsilon/V) \tag{4}$$

wherein the symbols used have the same meanings as in the expression (2). The expression (4), however, includes the distance $L_1$ instead of $L_2$. Most frequently $L_1$ is for Vidissector tubes about 5 mm. If it is thereat again assumed that $\epsilon = 0.3$ electron-volts and $L_2 = 200$ mm, it is sufficient to apply a voltage of 600 volts to the tube between the photocathode 10 and the mesh 21 in order that the diameter D of the electron image should not exceed 5 micrometers. For this example, the expression (3) indicates that a focusing field $B_F = 25.3$ Gauss shall be applied when focusing with $n = 1$. As deflection of the image is applied by means of the deflection field $B_R$, the dominating deviation, denoted with r, in the electrons from a point on the screen 12 is determined by the relation:

$$R = \left(\frac{m}{eB}\right)\left(\frac{2\pi n}{\omega^2}\right)[v_z^o(1 - \cos\omega) + v_y^o \sin\omega]\sqrt{2(1 - \cos\omega)} \cdot \theta^2 \tag{5}$$

wherein $v_z^o$ and $v_y^o$ indicate the initial speed components of the photoelectrons in the directions of the Z-axis and the Y-axis, respectively, in the coordinate system 0 in FIG. 2 and wherein the symbol $\omega$ is an angle determined by the expression $$\omega = 4\pi L_1 n/(L_1 + L_2) \tag{6}$$

The expression (6) shows that the quantity $\omega$ for Vidissector tubes is little, which may in the expression (5), owing to the term $1/\omega^2$, give rise to considerable deviations r, also with low deflection angles $\theta$. If we assume that $n = 1$ in the example discussed more extensively above, according to the expression (6) we obtain $\omega = 0.306$. If it is further assumed that in the expression (5) $V_z^o = 0$ and if such a speed volume is assumed for $V_y^o$ both in the positive and in the negative direction of the Y-axis as corresponds to an energy of 0.3 electron-volts, we obtain $r = \pm 34$ micrometers, i.e. a total deviation of about 68 micrometers for a deflection angle of $\theta = 5°$. This deviation far exceeds the extension that the electron image has without deflection (5 micrometers). Numerical calculations by means of a computer have confirmed this result. Therefore the Vidissector tube has a strongly reduced resolution in the parts of the image that are placed at the edges of the photocathode. This effect is enhanced by the fact that the expression (5) shows that the reduction of resolution increases quadratically with the deflection angle $\theta$.

From the expressions (5) and (6) it can be seen that the reduced resolution can be made to decrease by increasing the value of $\omega$. It is, however, noticed that a uniform resolution with deflection angles of up to 9° is obtained only when $\omega \geqq (3/2)\pi$. The relation (6) then indicates that an image dissector tube in accordance with the present invention shall meet the requirement $$4\pi n\, L_1/(L_1 + L_2) \geqq (3/2)\pi \tag{7}$$

Figure 3:
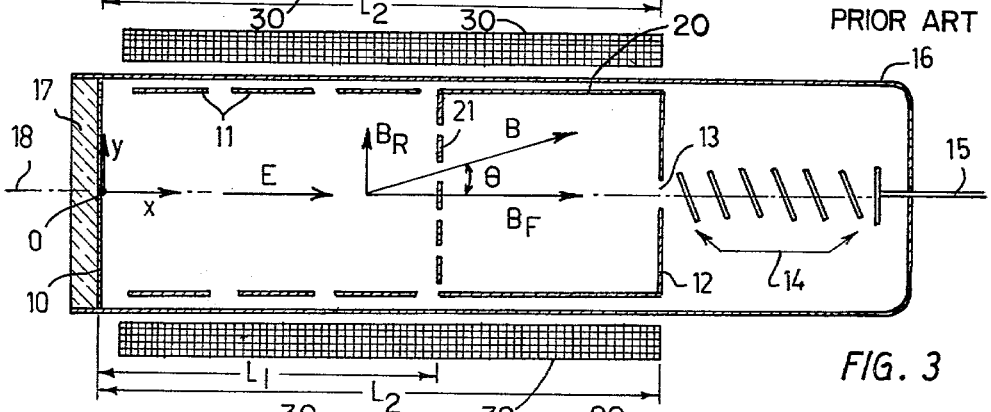
FIG. 3 shows an exemplifying embodiment of an image dissector tube in accordance with the invention.

When $n = 1$, the relation (7) results in $L_1 \geqq 0.6\ L_2$. When $n = 2$, the relation (7) results in $L_1 \geqq (3/13)\ L_2$. Such a tube in accordance with the invention in which $L_1 = 0.6\ L_2$ is shown in FIG. 3. In FIG. 3 there is the photocathode 10 and the screen 12 with the hole 13 shown, which screen is fastened to the metallic cylinder 20, to the other end of which the mesh 21 is fastened. Moreover, between the mesh 21 and the photocathode 10 ring-shaped electrodes 11, similar to those in the tube of FIG. 1, are placed, which electrodes, by means of joint effect with the mesh 21, produce an approximately axial electrostatic field E in the space between the photocathode 10 and the mesh 21 when an external voltage is applied between the mesh 21 and the photocathode 10. In other respects the function of the tube shown in FIG. 3 is similar to that described for the tubes in FIG. 1 and FIG. 2. Like in the tube of FIG. 2, the mesh 21, the cylinder 20, and the screen 12 form a space in which there is no electrostatic field. For the previous example, in which $L_2 = 200$ mm, $\epsilon = 0.3$ electron-volts, we obtain $L_1 = 120$ mm. In order that, according to expression (4), the same maximum extension D of the electron image should be obtained, an externally applied voltage of 14,000 volts is required, which is remarkably lower than the corresponding voltage that was required for the ring-dissector tube of FIG. 1. For the tube in accordance with the invention, according to the expression (3), focusing with the focusing field $B_F = 78.3$ Gauss is obtained. In the tube in accordance with the invention, the voltage exceeds the voltage in the tube in the Vidissector type, but the remarkable advantage is obtained that the resolution is maintained throughout the entire image face. For $L_1 \geqq (3/13)\ L_2$ the same example gives $L_1=46.2$ mm. In order that, according to expression (4), the same maximum extension D of the electron image should be obtained, an externally applied voltage of 5,500 volts is required, which is also remarkably lower than the corresponding voltage in the ring-dissector tube of FIG. 1. A focusing field $B_F=127.6$ Gauss is obtained according to the expression (3) and the focusing is herewith obtained for $n=2$.

Figure 4:
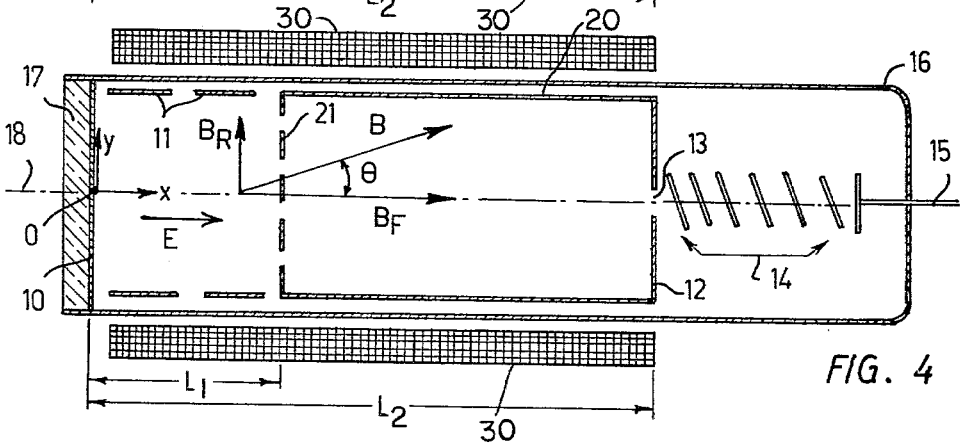
FIG. 4 shows another exemplifying embodiment of said tube in accordance with the invention.

From the expression (6) it is seen that the second-degree term in the deflection angle $\theta$ becomes zero if it is, in accordance with the expression (7) selected:

$$\omega=4\pi L_1 n/(L_1+L_2)=2\pi i \quad (9)$$

wherein i is an integer higher than 0. For $n=i$, the expression (9) results in $L_1=L_2$, i.e, in a tube of the ring-dissector type. Values of n and i fulfilling the relation $n>i$ results in an image dissector tube in accordance with the invention. An attractive tube in accordance with the invention is obtained if the values $n=2$ and $i=1$ are selected, whereby the expression (9) gives $L_1=(\frac{1}{3}L_2$. This relation should agree approximately. Such a tube in accordance with the invention is shown in FIG. 4, which is analogical to the tube in accordance with the invention shown in FIG. 3, but in the tube in accordance with the invention in FIG. 4 the length of the cylinder 20 has been adapted so that the distance between the photocathode 10 and the mesh 21 is $\frac{1}{3}$ of the distance between the photocathode 10 and the screen 12. With a focusing with $n=2$, which means that the electrons spin two revolutions in their movement from the photocathode 10 to the screen 12, this tube provides an unchanged good resolution even with very high deflection angles up to 25°. With high deflection angles, the tube must, however, be operated with dynamic focusing, which means that the external applied voltage or the focusing field $B_F$ is varied synchronically with the deflection. With the example discussed above, $L_2=200$ mm and $\epsilon=0.3$ electron-volts, we obtain $L_1=67$ mm. According to the expression (4) this means that an external voltage of 8,000 volts only is necessary in order that the maximum diameter D of the electron image should not exceed 5 micrometers. The focusing field that is required for focusing becomes, according to the expression (3), $B_F=142.1$ Gauss. With this tube in accordance with the invention, the same advantages are obtained in deflection as with ring-dissector tubes, but with a voltage of 8,000 volts only.

The invention is not restricted to the above exemplifying embodiments of the same, but the invention may be varied arbitrarily within the scope of the patent claims given below. Thus, in the screen 12 there may be two or more holes 13 with respective electron multiplier 14 and anode 15 for each hole. Moreover, the screen may also be a plate coated with phosphor in agreement with the technique applied in image-converter tubes and in image-intensifier tubes. Instead of the hole 13 in the screen 12, it is also possible to place one or more semiconductor components in the screen for detecting the electrons. The screen and the mesh may be placed at distances from the ends of the cylinder.

What is claimed is:

1. An image tube for electrical measurement of optical images, comprising a vacuum vessel with a central axis;

a window transparent to optical radiation fixed to one end of said vessel;

a photocathode positioned on the inside of said window, said photocathode emitting photoelectrons in response to optical radiation;

a metallic mesh spaced a distance $L_1$ from said photocathode;

a screen spaced a distance $L_2$ from said photocathode, said screen having an aperture for receiving electrons emitted from said photocathode;

external magnetic coils for providing a magnetic field along said electron path, said magnetic field being such that said electrons rotate a whole number n of revolutions along said path, there being from a minimum of 1 to a maximum of 3 revolutions n; and an electron detector positioned behind said aperture in said screen for detecting electrons travelling through said aperture, said mesh dividing the path of movement of electrons in said vessel into two parts, a first part from said photocathode to said mesh, and a second part from said mesh to said screen, said mesh and photocathode being adapted to be energized by an electrical voltage applied from the outside of said tube so as to provide along said first part of said electron path an electrostatic field which is approximately parallel to the central axis of said tube, said mesh and said screen being adapted to be energized at the same electrical potential, and said distances $L_1$ and $L_2$ and said number of revolutions n being related by the mathematical relation $$L_2 > L_1 \geqq \left(\frac{3}{8n-3}\right) L_2.$$

2. An image tube as claimed in claim 1, wherein the quantities $L_1$ and $L_2$, respectively, are selected so that the following mathematical relation is substantially fulfilled:

$$L_1 = \left(\frac{1}{2n-i}\right) L_2$$

wherein the symbol i is a positive integer and the symbol n has the same meaning as in claim 1, whereby the relation is valid only for such values of the symbols n and i as fulfill the relation $n>i$.

3. An image tube as claimed in claim 1, wherein $L_1 \geqq 0.6\ L_2$.

4. An image tube as claimed in claim 2, wherein $L_1=\frac{1}{3}L_2$.

5. An image tube as claimed in claim 2, wherein $L_1 \geqq (3/13)L_2$.

* * * * *